US005746087A

United States Patent [19]

Wurm et al.

[11] Patent Number: 5,746,087

[45] Date of Patent: May 5, 1998

[54] HEADING SLIDE GUIDING SYSTEM

[75] Inventors: Martin J. Wurm, Willard; Stanley J. Wasserman, Fremont, both of Ohio

[73] Assignee: The National Machinery Company, Tiffin, Ohio

[21] Appl. No.: 873,328

[22] Filed: Jun. 12, 1997

Related U.S. Application Data

[63] Continuation of Ser. No. 504,350, Jul. 19, 1995.

[51] Int. Cl.[6] ..... B21J 13/04

[52] U.S. Cl. ..... 72/456

[58] Field of Search ..... 72/455, 456; 100/214

[56] References Cited

U.S. PATENT DOCUMENTS

| | | | |
|---|---|---|---|
| 3,388,583 | 6/1968 | Nye | 72/456 |
| 3,903,993 | 9/1975 | Vorrhees et al. | 184/5 |
| 4,635,465 | 1/1987 | Ashelman, Jr. et al. | 72/455 |
| 4,854,152 | 8/1989 | Portmann | 72/456 |
| 4,910,993 | 3/1990 | Hite et al. | 72/455 |

FOREIGN PATENT DOCUMENTS

| | | | |
|---|---|---|---|
| 595205 | 11/1947 | United Kingdom . | |
| 0641586 | 8/1950 | United Kingdom | 72/456 |

*Primary Examiner*—Lowell A. Larson
*Assistant Examiner*—John Paradiso
*Attorney, Agent, or Firm*—Pearne, Gordon, McCoy & Granger LLP

[57] ABSTRACT

Clearance take up means is provided to take up the running clearance between the bed frame and slide of a progressive former at least near the end of the advance of the slide to top dead center, so that the advance is completed under essentially zero clearance conditions. A header slide system must allow a certain amount of running clearance to give room for lubricant and allow for expansion of the slide and bed due to variations in the temperature of the slide and bed. This clearance however compromises the concentricity of the work piece. The present invention enables normal running clearances to be maintained; however, near the front of the slide stroke clearances are eliminated completely by putting a side load on a system of wedges. This system reduces the side to side movement of the slide as well as the cocking about the vertical axis of the slide that occurs with offset heading loads.

12 Claims, 9 Drawing Sheets

HEADING SLIDE GUIDING SYSTEM

This is a continuation of application Ser. No. 08/504,350, filed Jul. 19, 1995.

FIELD OF THE INVENTION

This invention relates generally to progressive formers, and more particularly to a novel and improved progressive former apparatus and method providing and maintaining very accurate alignment of tooling carried on the slide with tooling carried on the die breast as work pieces are formed by the tooling.

BACKGROUND OF THE INVENTION

Progressive formers or progressive forging machines usually provide a die breast forming part of or mounted on the bed frame of the machine. A slide is also mounted on the bed frame for reciprocation toward and away from the die breast. A suitable drive is provided to reciprocate the slide. Such drive may, for example, be a crank and pitman drive or a toggle drive. Dies mounted in the die breast cooperate with tools carried by the slide to provide work stations at which work pieces are progressively formed to required final shape.

Such machines also provide transfers which progressively transport the work pieces to each work station, where successive forming of the work piece occurs. Many such machines include a cutter which cuts work pieces from the end of rod or wire stock. Such machines may, for example, provide two or more work stations.

Progressive formers are generally designated by the diameter of the stock which is forged and the number of work stations provided. For example, machines for forming one-half inch stock are generally referred to as one-half inch machines even though they may provide from two to five work stations or more. Such machines may be cold formers which work unheated stock, warm formers which are supplied with stock heated to an elevated temperature below the recrystallization temperature of the stock, or hot formers which work stock heated to a temperature above the recrystallization temperature of the stock.

A header slide system must allow a certain amount of running clearance to give room for lubricant and allow for expansion of the slide and bed due to variations in the temperature of the slide and bed. This clearance however compromises the concentricity of the work piece.

It is known in U.S. Pat. No. 4,910,993 of common assignee to accomplish tracking of the slide advance with reference to a favored guide interface and independently of thermal expansion of the frame and of tolerance variations in the spacing between the side members of the bed frame.

SUMMARY OF THE INVENTION

The present invention enables normal running clearances to be maintained; however, near the front of the slide stroke clearances are eliminated completely by putting a side load on a system of wedges. This system reduces the side to side movement of the slide as well as the cocking about the vertical axis of the slide that occurs with offset heading loads.

Thus, according to the present invention, accurate and consistent tracking of the reciprocating slide on the bed frame is accomplished with adequate lateral running clearance for efficient reciprocation of the slide, but with means to take up such clearance as tooling mounted on the slide completes its advance into working relationship with tooling on the die breast to thereby accomplish and maintain very accurate alignment of one with the other as work pieces are formed by the tooling, an accuracy of alignment which continues to top dead center. It is particularly advantageous to eliminate running clearance before the tooling on the slide engages work pieces at the work stations if the unformed work pieces are bilaterally asymmetric, or if the distribution of forming forces among the several work stations is uneven so as to tend to cock the slide and tooling supported thereon.

In a further aspect of the invention, prior to such taking up of sliding clearance during completion of slide advance, the tracking of the advancing slide may be accomplished in the above-mentioned known manner with reference to a favored guide interface. When such favored-guide-interface tracking is thus combined with the above-mentioned take up of sliding clearance, accuracy of alignment during the actual forming operation is further enhanced. With such combination, the taking up of clearance does not require lateral displacement of either of the guide elements associated with such favored guide interface. As the slide advances, they remain at all times slidingly engaged with each other at the favored guide interface.

DETAILED DESCRIPTION

Figure 1:
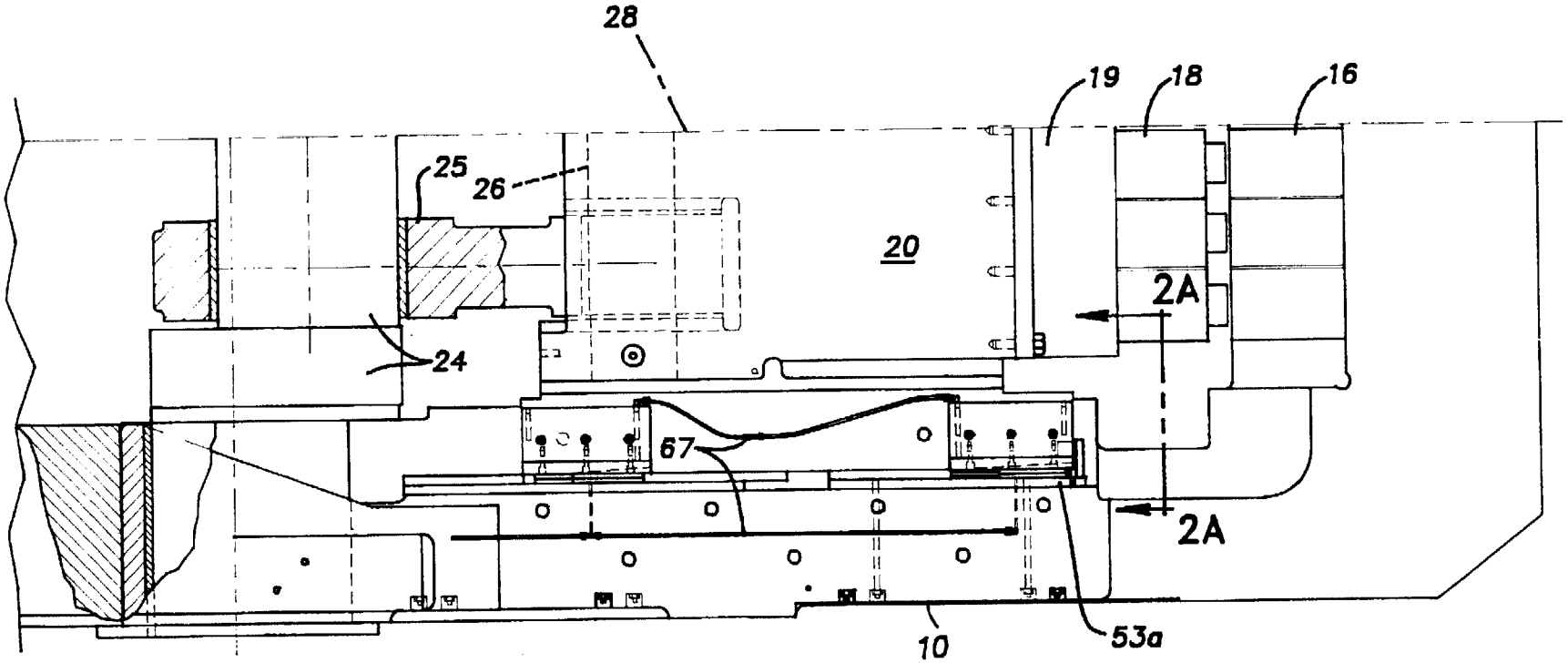
FIG. 1 is a fragmentary plan view of one side of a machine embodying the invention, with certain parts removed, taken from line 1—1 in FIG. 2A.
Figure 2A:
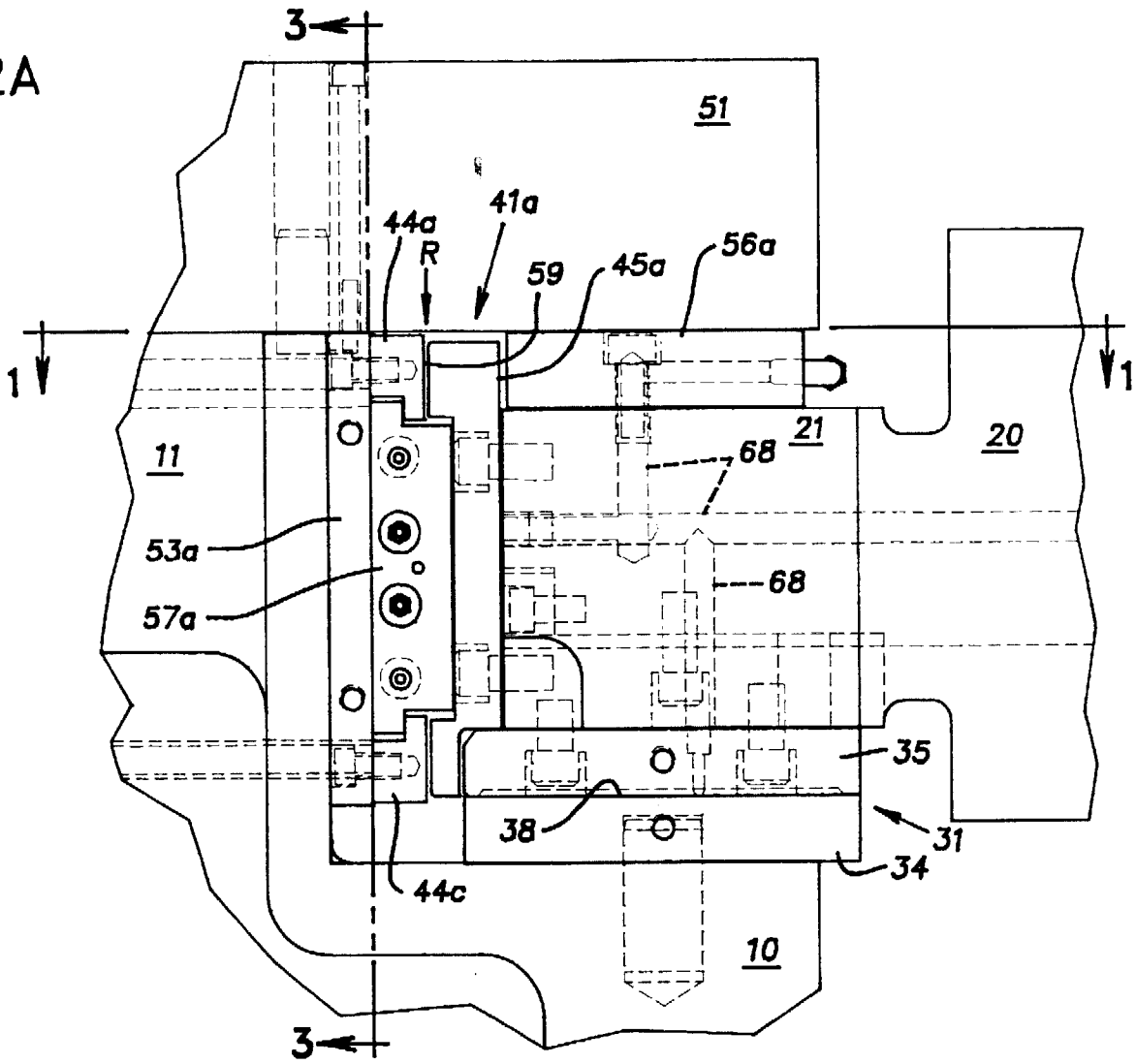
FIG. 2A is a view toward the rear of the machine taken from line 2A—2A in FIG. 1 and on a larger scale.
Figures 2B, 6:
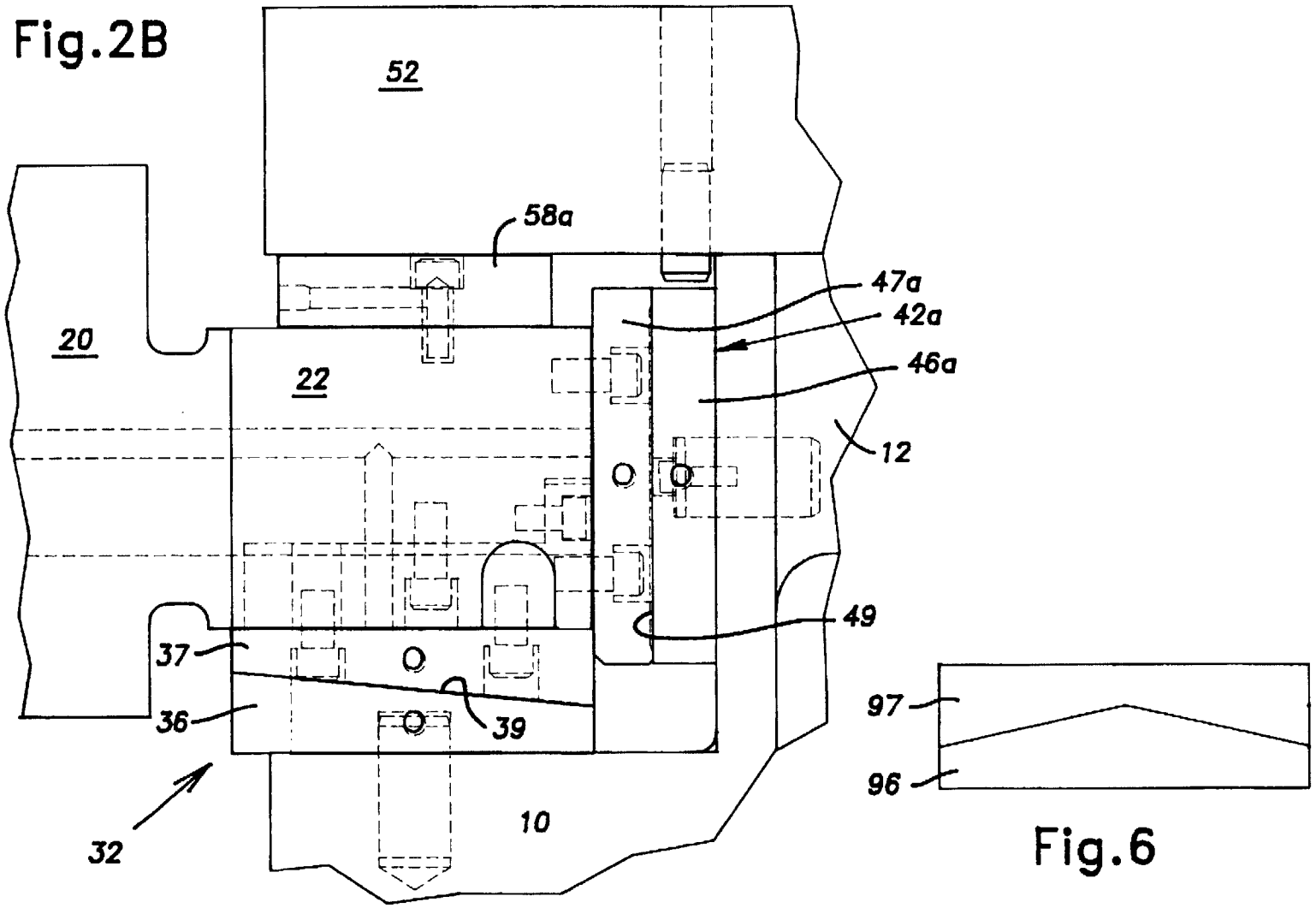
FIG. 2B is a view toward the rear of the machine similar to FIG. 2 but showing the opposite side of the machine.
FIG. 6 is a view on the same scale as FIG. 2B showing an alternative shape of certain guide members.

Referring to the drawings, the invention may be embodied in a machine having a one-piece cast bed frame 10 (FIGS. 1, 2A, 2B). The bed frame includes side frame members 11 and 12 (FIGS. 2A and 2B) at the two sides of the machine. Alternatively, the bed frame may be formed as an assembly, the two side frame members comprising steel plate separated by spacers, in the manner shown in U.S. Pat. No. 4,910,993 to common assignee.

At the front or working end of the machine, the stationary tooling of the machine is carried by a die breast 16 which is mounted either directly or via a back-up plate (not shown) on the bed frame or on a breast plate forming part of the frame or bolted thereto. The stationary tooling is not shown but would normally be mounted in die openings formed in the die breast 16. The reciprocating tooling is carried in openings formed in the tool holder 18 carried on the punch block 19 which in turn is mounted on the face of the header slide 20.

The header slide is formed with wings 21 and 22 (FIGS. 2A and 2B). The header is advanced and retracted by a suitable drive such as the crank and pinion linkage partly seen in FIG. 1 and comprising the crankshaft 24, a pair of laterally spaced pitmans 25, and wrist pin 26 which connects the pitmans to the header slide 20. Only one of the two pitmans is seen in FIG. 1, the other being located on the opposite side of the machine's center line 28 and equidistant therefrom.

The slide wings are supported on the bed frame by laterally spaced bearing assemblies 31 and 32. The bearing assembly 31 includes the steel bearing member 34 fixed to the bed frame 10 and the bronze bearing member 35 bolted to the slide wing 21. The interface 38 between these bearing members is horizontal. The bearing assembly 32 includes the steel bearing member 36 fixed to the bed frame 10 and the bronze bearing member 37 bolted to the slide wing 22. These bearing members are formed with an outwardly and downwardly extending interface 39, preferably at a 5 degree angle, so the weight of the slide supported by the bearing assembly 32 creates a bias tending to move the slide in a direction to the right as illustrated in FIGS. 2A and 2B. The weight supported by the bearing assembly 31 does not produce any lateral bias on the slide, since the interface 38 is horizontal.

The lateral position of the header slide 20 is established by a bearing assembly **42*a* which includes a stationary vertically extending steel bearing plate 46*a* bolted to the side frame member 12 and a bronze bearing plate 47*a* bolted to the slide wing 22. These two bearing plates provide an interface 49** which prevents movement of the slide to the right beyond the position illustrated in FIGS. 2A and 2B. This illustrated bearing assembly is associated with the leading end of the slide. A duplicate bearing assembly (not shown) is provided on the same side of the slide in association with its trailing end.

Movement of the slide to the left is limited by guide elements at the other side of the machine which form a bearing assembly **41*a*. These elements include stationary steel gibs 44*a* and 44*c* which are bolted to a steel plate 53*a* which in turn is bolted to the side frame member 11, and moving front wedging liner 45*a* bolted to the slide wing 21 and made of bronze. The interface 59 between these elements is normally disengaged and a small lateral clearance or running clearance R is provided, as indicated in the drawings. This running clearance may also be established along the length of the slide stroke by additional block and plate elements located along the length of the machine, i.e., behind the elements 44*a*, 44*c* and 45*a*** as viewed in FIG. 2A. These additional elements are identified in the description of means to take up the running clearance which is set forth several paragraphs below.

The steel bearing plate **53*a* preferably has an 0.010 inch bronze cladding on its working face. The two surfaces of each of the gibs 44*a* and 44*c*** that intersect at the gib's inside corner preferably comprise a 0.010 inch bronze cladding.

The slide is held down at each side of the machine by the stationary caps 51 and 52 bolted to the side frame members 11 and 12. These are positioned for a running clearance with nylon liners **56*a* and 58*a* which are bolted to the top surfaces of the slide wings 21 and 22**.

With this structure, in which a bias is provided to maintain engagement at the interface 49, very accurate lateral positioning of the slide is provided. Further, since the lateral guiding of the slide 20 is provided only on the side frame member 12, any tolerance variation in the spacing between the two side frame members 11 and 12 does not in any way adversely affect the lateral positioning of the slide. Also, this structure for laterally positioning the slide eliminates lateral positioning inaccuracy created by thermal expansion of the bed frame or by load-induced frame deflections.

The bearing elements, plates, gibs and shoe described will be understood to comprise guide means including guide elements associated respectively with the bed frame 10 and slide 20 for guiding the slide by constraining it against lateral motion during its advance toward the die breast 16. The lateral spacing between the faces of the frame-mounted steel guide element **46*a* from the frame-mounted guide elements 44*a* and 44*c* together with the lateral spacing between the faces of the slide-mounted bronze guide elements 47*a* and 45*a*** provide the running clearance between the bed frame and slide.

Figure 3:
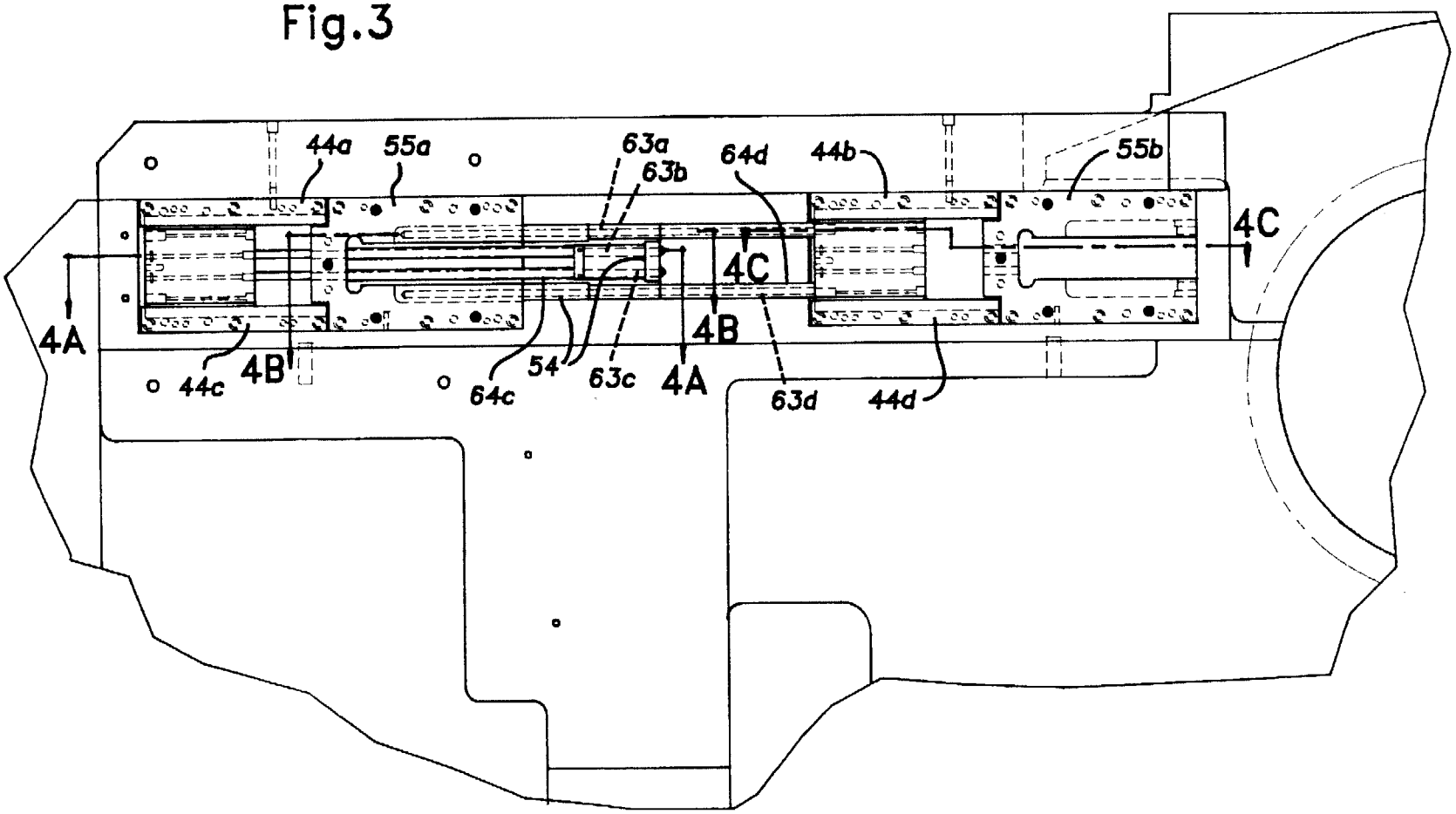
FIG. 3 is a view on a smaller scale taken from line 3—3 in FIG. 2A.
Figure 4A:
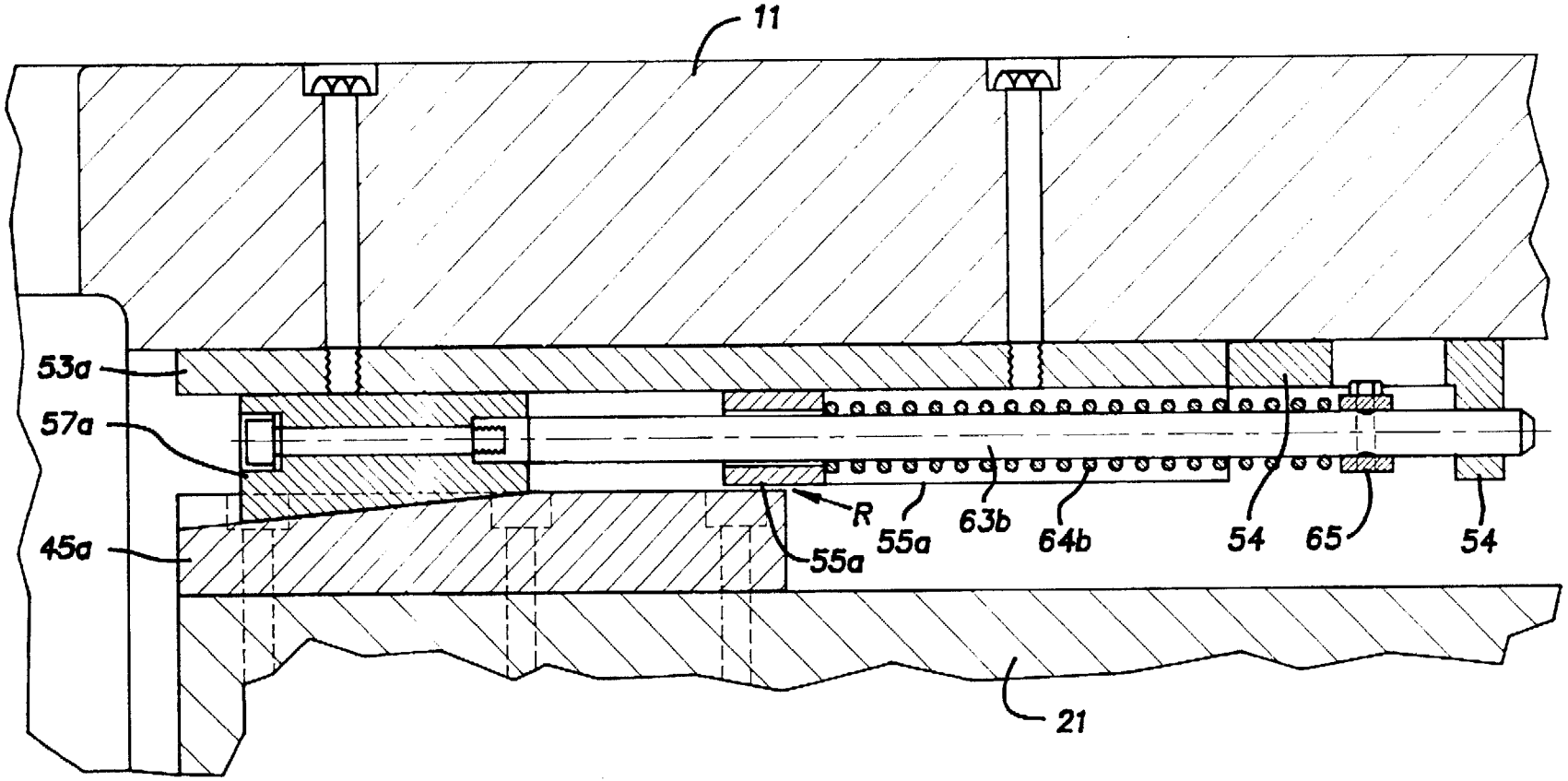
FIGS. 4A, 4B and 4C are cross-sectional views taken on lines 4A—4A, 4B—4B and 4C—4C of FIG. 3 on a larger scale.
Figure 4B:
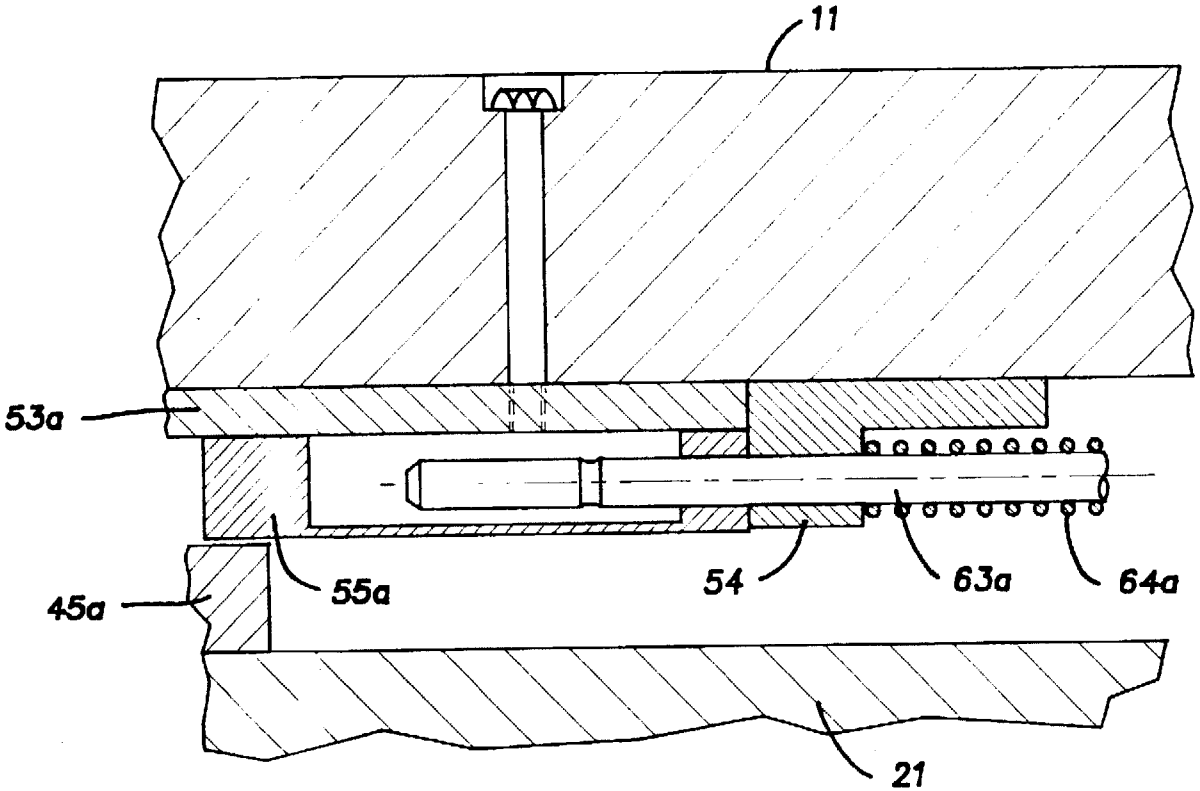

In the illustrated embodiments of the invention, this running clearance applies during the majority of the advance stroke of the slide toward the top dead center position. Means is provided to take up the running clearance toward the end of the advance stroke. Preferably the clearance is taken up before the tooling carried on the slide by the tool holder 18 advances into working relationship with the tooling on the die breast 16. In the illustrated embodiments of the invention, this take-up means is provided at one side of the slide. As best seen in FIG. 3 taken together with FIGS. 4A, 4B and 4C, take-up linkages and elements are guided by the fixed plates **53*a* and 53*b*, rod guide member 54, and blocks 55*a* and 55*b*. These blocks are preferably formed of black cast nylon. Take-up of lateral clearance is accomplished by wedging action between front wedging liner 45*a* and a front sliding wedge block 57*a* toward the leading end of the slide, and between rear wedging liner 45*b* and rear sliding wedge 57*b*** toward the trailing end of the slide. It is to be noted that the wedging actions at the front and rear of the slide are independent of each other. The sliding wedge blocks are preferably fabricated of Delrin AF which is acetal resin marketed under registered trademark of Dupont. The wedging face of each member is preferably angled at 3 degrees.

The illustrated take-up linkage includes spring rods **63*a* 63*b*, 63*c* and 63*d* each with its associated surrounding compression spring 64*a*, 64*b*, 64*c* or 64*d***. The springs as illustrated are each divided lengthwise into four end-to-end segments.

Figure 4C:
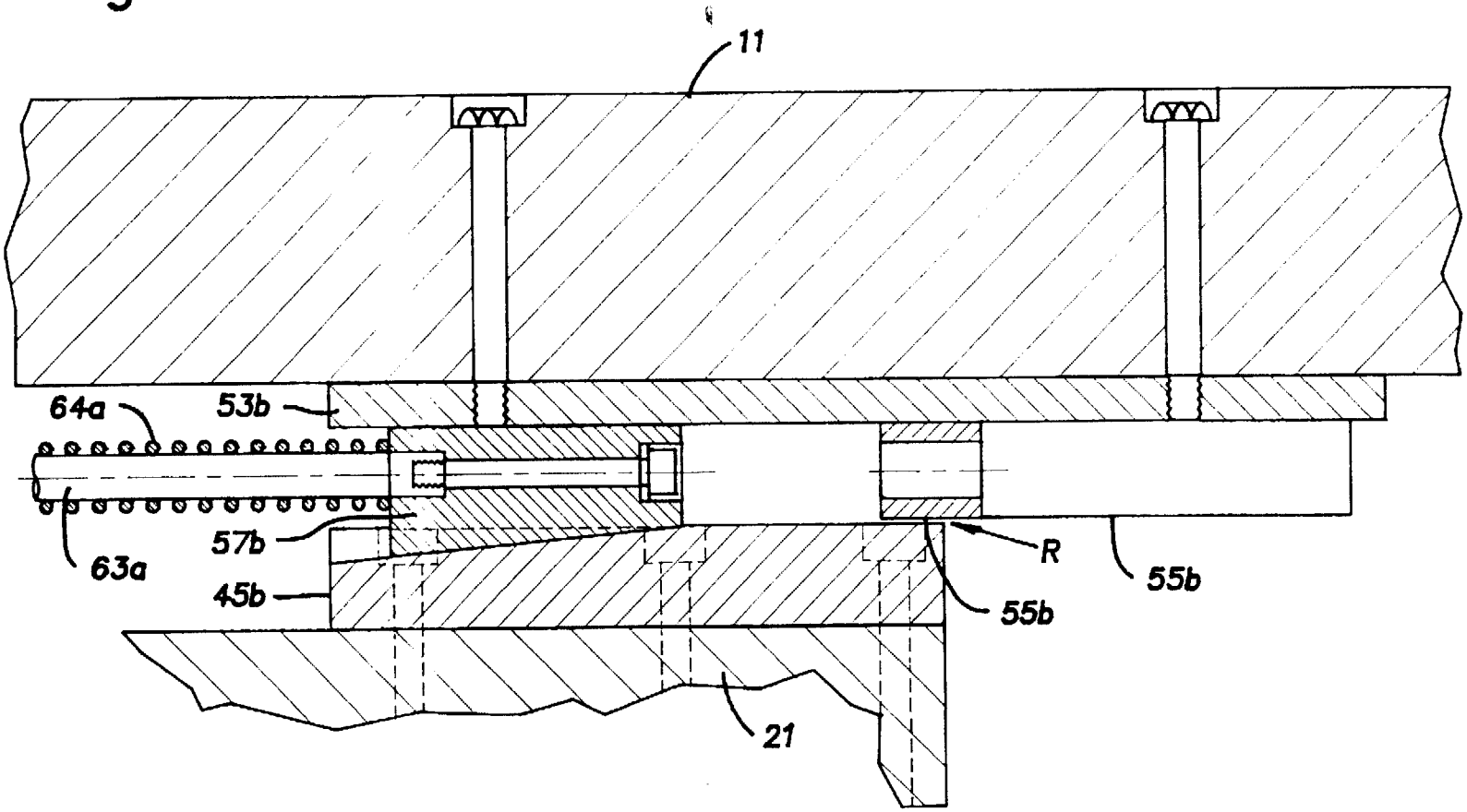

Rods **63*b* and 63*c* are tied to the front wedge block 57*a*, and rods 63*a* and 63*d* are tied to a rear wedge block 57*b*. Since the front sliding wedge block 57*a* pulls on its associated rods 63*b* and 63*c*, as described below, a clamp 65 is fixed to them and is positioned to engage the ends of the springs 64*b* and 64*c* in order to cause such pull to compress them. The rear sliding wedge block 57*b* does not pull on its associated rods 63*a* and 63*d* but rather directly engages the ends of the springs 64*a* and 64*d*, and these rods acting merely as guides for the springs. When the slide is in retracted position, the wedging liners 45*a* and 45*b* are disengaged from the sliding wedges 57*a* and 57*b* and all the springs are in minimum-load condition. As the slide advances, the wedge faces of the liners 45*a* and 45*b* contact the faces of the wedges 57*a* and 57*b* and the wedges are pulled in the advancing direction, compressing the springs. For springs 64*b* and 64*c*, compression occurs via pulling forces on the rods 63*b* and 63*c*. For springs 64*a* and 64*d*, compression occurs by direct engagement of their ends by sliding wedge 57b as best seen in FIG. 4C. As the wedges advance with the slide, they themselves slide on the stationary plates 53a and 53b**.

The engagement and wedging action between the parts takes up the running clearance between the slide-carried and the frame-supported guide members. Preferably, the running clearance is taken up before the tooling carried on the slide by the tool holder 18 advances into working relationship with the tooling on the die breast 16, i.e., before the slide-carried tooling contacts the work pieces. After the running clearance is taken up, the parts continue their advance to top dead center position of the slide, during which time the tooling carried on the slide engages the work pieces and the work pieces are formed.

It may be noted that throughout the advance to top dead center position, and both before, during and after the running clearance is taken up, neither guide element of the bearing assembly 42a moves laterally; rather they remain slidingly engaged with each other at the favored guide interface 49 at all times. The same is true of the bearing assembly (not illustrated) which duplicates assembly 42a and is associated with the trailing end of the slide.

Lubricant feed is maintained through lines 67 and passages 68, and through additional lines and passages (not illustrated), so as to maintain the distribution of lubricant on all sliding interfaces. In this connection, although the elements of the bearing assembly 42a are shown in contact at the favored guide interface 49, a thin lubricant film having a thickness of about half a thousandth of an inch is present between the metal faces.

After taking up of running clearance, the slide advance is completed at what may be referred to as zero clearance. However, this term does not refer to solid-to-solid contact between the parts, but rather to a condition where the thickness of the film of lubricant between the parts does not exceed about half a thousandth inch of an inch.

The running clearance R of the machine may be about 15 thousandths of an inch for larger machines, varying down to about 5 thousandths for smaller machines. When the machines reach thermal equilibrium under running conditions, these clearances may reduce to only say 2 thousandths.

The wedging interfaces between the elements 45a and 57a and between elements 45b and 57b are angled shallowly, a preferred angle being in the order of three degrees to provide a taper lock type action. Lubrication of the interfaces between elements 57a and 53a and between elements 57b and 53b requires particular consideration, since the proper operation of the parts must represent a proper balance between two opposing tendencies. One of these tendencies is taper lock. If lubrication at the referenced interfaces (elements 57a, 53a; 57b, 53b) is reduced too far, the parts will effectively lock against relative sliding movement at the shallow angles involved. The opposing tendency can be referred to as a "watermelon seed effect." If the film of lubricant is too thick in dimension or too pressurized, the wedges may pop forwardly from their wedging interfaces like a squeezed watermelon seed, so that undesirably the clearance increases or at least fails to continue to reduce to the zero clearance condition. No definitive spring pressures or feed pressures are believed to apply, since circumstances vary widely as between machines of different sizes working under different operating conditions. However, a proper balance between these tendencies in any given installation, or for a prototype machine intended as model for operation under any given standardized circumstances, can be achieved by trial and error changes of lubricant feed pressure and spring loading or rate. A typical spring compressive force at zero clearance condition might be say 100 pounds, and a typical lubricant feed pressure to the referenced interfaces say 40 psi.

On the return stroke of the slide, the wedges 57a and 57b are pushed in the return direction by the compressed springs until the wedging liners 45a and 45b move beyond the range of movement of the sliding wedge blocks, or until the springs reach unloaded condition. In the illustrated embodiment, retracting movement of the wedge block 57a is limited by contact between elements 57a and 55a, and retracting movement of the wedge block 57b is limited by contact between elements 57b and 55b.

Figure 5A:
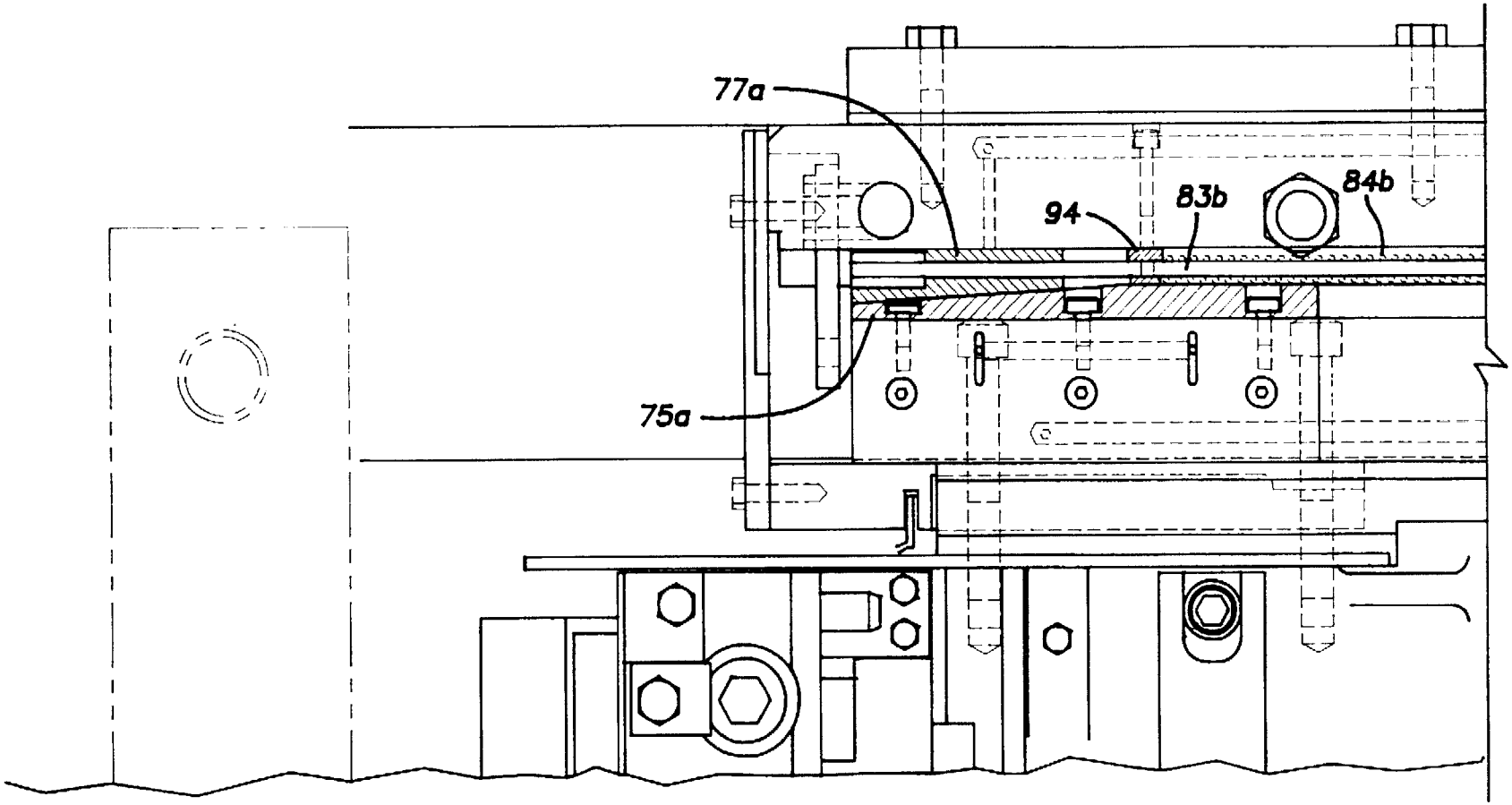
FIG. 5A is a fragmentary plan view of another embodiment of the invention.
Figure 5B:
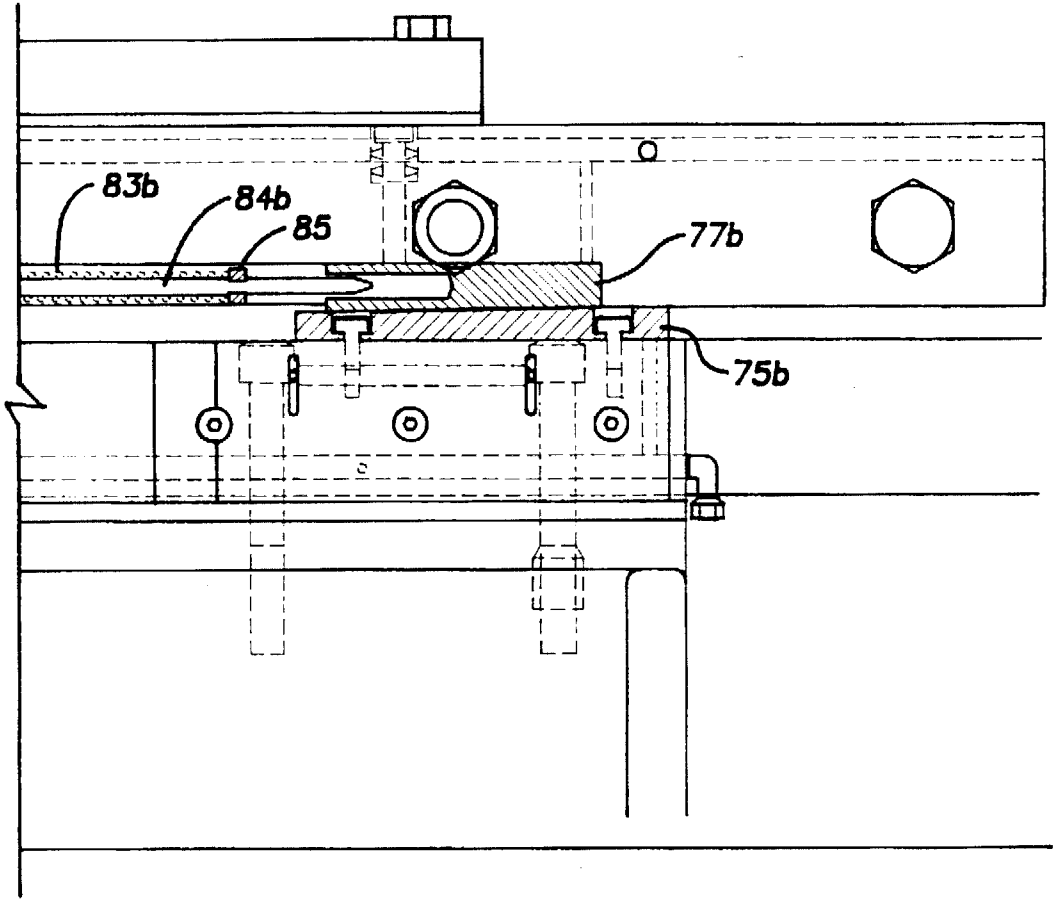
FIG. 5B is an extension of FIG. 5A. The direction of view corresponds to that of FIGS. 4A, 4B and 4C of the first embodiment, and the machine portion shown in FIGS. 5A and 5B, taken together, generally corresponds to the portion of the first embodiment that is shown in combined FIGS. 4A, 4B and 4C, with parts shown on a somewhat different scale, and with only the wedging parts, clamp and rod guide member shown in section.

In some installations, particularly in smaller machines, deflection of the bed frame 10 and/or the slide 20 under operating loads may be sufficient to allow use of a fixed wedge in association with the trailing end of the slide, so that only a single sliding wedge is employed, associated with the leading end or working end of the slide. Such a clearance take up linkage is illustrated in FIGS. 5a and 5B. A front wedging liner 75a, sliding wedge block 77a, spring rod 83b, compression spring 84b and clamp 85 correspond to the front wedging liner 45a, front sliding wedge block 57a, spring rod 63b, compression spring 64b and clamp 65 of the previously-described linkage, and together with underlying elements (such as a second rod and spring) not visible in the drawings, operate in generally the same way to take up the running clearance at the front end of the slide, the spring reacting against a fixed rod guide member 94.

However the rear wedge 77b is fixed to the frame, and its wedging face is formed at a comparatively small angle, preferably a one degree angle, as is the wedging face of the rear wedging liner which engages it. The wedging action between these parts jams the parts together and applies brute force to bend the frame slightly and eliminate clearance at the rear end of the slide.

As disclosed above, the taking up of sliding clearance is accomplished by take-up means at one side of the slide, and running clearance prior to take-up is maintained only at the opposite side of the slide. The invention also contemplates maintaining and taking up a running clearance at each side of the slide. Thus, for example, the biasing bearing members 36 and 37 could be replaced with the members 96 and 97 shown in FIG. 6, so that the slide would tend to be centered by the centering action of such shaped guide members, the parts could be dimensioned to provide running clearances at each side of the slide, and take up means similar to those shown in FIGS. 4A, 4B and 4C, or in FIGS. 5A and 5B, could be provided at each side of the slide.

The invention is not limited to the details of the specific embodiments shown, many of which may be changed, added to or eliminated while still practicing the invention. The invention is to be determined by the scope of the following claims, interpreted in light of the above disclosure.

What is claimed is:

1. A progressive former comprising a machine bed frame, a die breast on said frame, a powered slide reciprocable on said frame to advance toward and retract away from said die breast, tooling mounted on said slide and die breast cooperating to define a plurality of work stations for progressively forming work pieces, said tooling on said slide being advanced into and maintained in working relationship with said tooling on said die breast as said slide completes its motion toward said die breast on each advance stroke, guide means including guide elements associated respectively with said frame and said slide for guiding said slide by constraining it against lateral motion at least during its advance toward said die breast, guide elements associated with said frame and guide elements associated with said slide having their guide faces laterally spaced to provide a running clearance between said frame and slide during the majority of each said advance stroke of said slide, and clearance take-up means for substantially eliminating said clearance toward the end of said advance stroke but before said tooling on said slide advances into working relationship with said tooling on said die breast, said clearance take-up means including a pair of complimentary wedging surfaces mutually engageable through movement of the slide to take-up clearance and thereafter remain substantially motionless with respect to one another during the tool working part of the advance stroke of the slide.

2. Apparatus as in claim 1, said take up means comprising means that is activated in its take up function by engagement by elements carried by said slide.

3. Apparatus as in claim 2, said take up means comprising travelling means that, following said engagement, travels with said slide during the time said tooling on said slide advances into and is maintained in working relationship with said tooling on said die breast.

4. Apparatus as in claim 3, including facing guide elements and means providing a favored guide interface at which sliding contact between said facing guide elements is maintained and lateral movement of said slide in one lateral direction is constrained, means providing another interface including facing elements for constraining lateral movement of said slide in the opposed lateral direction, whereby both before and after said taking up of said clearance the tracking of the advancing slide with reference to said favored guide interface is maintained independently of thermal expansion of the frame and of tolerance variations in the spacing between a guide element of said favored guide interface and an element of said another interface.

5. Apparatus as in claim 4, wherein one of said facing guide elements is stationary, said means for providing a favored guide interface including biasing means for biasing said slide toward the stationary one of said facing guide elements at said favored guide interface.

6. Apparatus as in claim 5, said biasing means including spaced bearings supporting said slide for horizontal reciprocation, at least one of said bearings being shaped so that the weight of said slide biases said slide toward said stationary one of said facing guide elements at said favored guide interface.

7. A progressive former as in claim 1, wherein one of said wedging surfaces is fixed on the slide and the other wedging surface is stationary with respect to the frame during an initial part of the advance stroke of the slide and moves with the slide during the tool working part of the advance stroke of the slide.

8. A progressive former as in claim 7, including resilient biasing means arranged to urge said other wedging surface in a direction opposite the advance stroke direction of the slide.

9. In a progressive former comprising a machine bed frame, a die breast on said frame, a powered slide reciprocable on said frame to advance toward and retract away from said die breast, tooling mounted on said slide and die breast cooperating to define a plurality of work stations for progressively forming work pieces, said tooling on said slide being advanced into and maintained in working relationship with said tooling on said die breast as said slide completes its motion toward said die breast on each advance stroke, the improvement which comprises clearance take-up means for taking up running clearances between said slide and said machine bed frame to establish zero clearance during the completion of said advance stroke, including a pair of complimentary wedging surfaces mutually engageable through movement of the slide to take-up clearance and thereafter remain substantially motionless with respect to one another during the tool working part of the advance stroke of the slide.

10. Apparatus as in claim 9, said take up means comprising means that is maintained in its take up function by engagement by elements carried by said slide.

11. Apparatus as in claim 10, said take up means comprising travelling means that, during said engagement, travels with said slide during the time said tooling on said slide advances into and is maintained in working relationship with said tooling on said die breast.

12. Apparatus as in claim 11, said travelling means comprising at least one spring-biased sliding wedge-block carried on said frame, said wedge-block having an angled wedging face, a corresponding wedging liner carried on the slide and having a wedging face for engagement with said wedging face of said sliding wedge-block, said engaged members thereby acting together to wedgingly take up lateral clearance as said wedging liner also urges said wedge-block, against its spring biasing, to slide in the advancing direction.

* * * * *